US005810577A

United States Patent [19]

Ledjeff

[11] Patent Number: 5,810,577

[45] Date of Patent: Sep. 22, 1998

[54] CATALYTIC BURNER

[75] Inventor: Konstantin Ledjeff, Bad Krozingen, Germany

[73] Assignee: Fraunhofer-Gesellschaft zur Forderung der Angewandten Forschung E.V., Munich, Germany

[21] Appl. No.: 600,986

[22] PCT Filed: Aug. 24, 1994

[86] PCT No.: PCT/DE94/00994

§ 371 Date: May 2, 1996

§ 102(e) Date: May 2, 1996

[87] PCT Pub. No.: WO95/07438

PCT Pub. Date: Mar. 16, 1995

[30] Foreign Application Priority Data

Sep. 6, 1993 [DE] Germany ..... 43 30 130.4

[51] Int. Cl.[6] ..... F23D 14/12; F23D 21/00; F23C 6/00

[52] U.S. Cl. ..... 431/170; 431/7; 431/326; 431/328

[58] Field of Search ..... 431/7, 170, 326, 431/328; 126/91 A

[56] References Cited

U.S. PATENT DOCUMENTS

| | | | |
|---|---|---|---|
| 3,912,443 | 10/1975 | Revault et al. | 431/329 |
| 3,975,140 | 8/1976 | Placek | 431/329 |
| 4,878,837 | 11/1989 | Otto | 431/329 |
| 5,160,254 | 11/1992 | Bell et al. | 431/7 |
| 5,395,235 | 3/1995 | Lan-Sun Hung | 431/328 |

FOREIGN PATENT DOCUMENTS

| | | | |
|---|---|---|---|
| 0389652 | 10/1990 | European Pat. Off. . | |
| 2127465 | 10/1972 | France . | |
| 251567 | 2/1911 | Germany | 431/328 |
| 4204320 | 8/1993 | Germany . | |
| 61-93307 | 5/1986 | Japan . | |

OTHER PUBLICATIONS

LEDJEFF, K., "Wasserstoffnutzung Durch Katalytische Verbrennung" *BWK,* vol. 7–8, pp. 370–374 (1987).

English Language Abstract of JP–61–93307.

*Primary Examiner*—Carl D. Price

*Attorney, Agent, or Firm*—Greenblum & Bernstein, P.L.C.

[57] ABSTRACT

The invention concerns a two-stage catalytic burner (1) with at least one feed (3) for a hydrogen or hydrocarbon-containing fuel gas and at least one feed (17) for a combustion gas such as oxygen or air, two combustion stages (15, 16), the second (16) of which is a monolithic burner through which the mixture of gases leaving the first stage (15) passes, and a heat exchanger (8) connected to the burner (1). The first combustion stage (15) is a diffusion burner in which a chamber (6) containing fuel gas is separated from the chamber (7) containing combustion gas by a catalytic layer (burner element 4) which is permeable to the fuel gas. The burner element (4) is made of highly porous catalytically active material with a porosity of >50% and pore size of 0.001 to 100 $\mu$m and has a thickness of 0.05 to 10 mm. The fuel gas is fed into chamber (6) and the combustion gas into chamber (7).

15 Claims, 4 Drawing Sheets

CATALYTIC BURNER

CROSS REFERENCE TO RELATED APPLICATION

The present application claims priority under 35 U.S.C. § 119 of German Patent Application No. P 43 30 130.4, filed Sep. 6, 1993

BACKGROUND OF THE INVENTION

1. Field of the Invention

The invention relates to a two-stage catalytic burner, in which the first combustion stage is designed in the form of a diffusion burner.

Similarly to flame burners, catalytic burners can be classified according to the type of mixture formation. A distinction is drawn between burners without and with pre-mixing.

2. Discussion of Background Information

In contrast to flame burners, the stability ranges with catalytic combustion are clearly wider, and therefore conversion is not so easily disturbed by operational fluctuations. Particularly when hydrogen is used, this advantage becomes very noticeable, so that catalytic $H_2$ burners can be relatively simple in construction. For this reason also, and also due to the extreme ease of oxidation of hydrogen on catalysing contacts, catalytic burners are eminently suitable for use within the framework of hydrogen technology.

Catalytic burners without pre-mixing, also called diffusion burners, are used for special applications. Technical appliances are on the market for use in the leisure area and as infra-red dryers. In addition to their use as infra-red dryers, catalytic burners are mainly used as heating appliances for camping, boats, holiday houses and as mobile heating appliances.

In this case the catalytic burner is so constructed that the pure fuel gas, after it has been distributed in a chamber, flows at a homogeneous speed through a planar porous catalyst. The atmospheric oxygen necessary for combustion then diffuses out of the environment into the catalyst structure and catalytic combustion takes place in the zone close to the surface. The reaction heat is emitted by reflection and radiation.

Such a diffusion burner for operation with hydrogen is described in the article by K. Ledjeff "Use of hydrogen through catalytic combustion, BWK, Volume 39 (1987), No. 7/8, pages 370–374. This diffusion burner has an approximately tubular supply for the fuel gas and connected therewith a chamber for the fuel gas whose walls are constructed from a sintered metal. These sintered metals, made for example from special steel, are commercial products.

This burner, however, is unsuitable for operation with fuel gases containing hydrocarbons. The catalytic combustion of hydrocarbons is considerably more difficult than the combustion of hydrogen, as the fuel gases present in a gaseous form are extremely stable. For example, methane is so stabilised by its molecular structure that catalytic activation even on platinum begins only from extremely high temperatures of at least approximately 300° C. In order to obtain total catalytic combustion of methane or natural gas, which consists mainly of methane, it is necessary to use highly-active catalysts, e.g. noble metals on ceramic carriers. These catalysts, however, are subject to ageing, the conversion rates deteriorating in time and the burners emitting increasing amounts of contaminants. This is the reason why the burner described above is unsuitable in particular for fuel gases containing hydrocarbons, as incomplete combustion results with high emissions or even with unconsumed fuel gas.

A further diffusion burner is described in EP 0 389 652 A1. This diffusion burner is so constructed that the fuel gas firstly passes through a diffusion layer with a relatively high flow resistance and then enters a catalytically active layer, which is placed on the diffusion layer. In this case the catalytically active layer has zones of differing activity.

This burner is indeed intended for hydrogen and for fuel gases containing hydrocarbons. Here also it has become apparent that the disadvantages described above are not totally removed, so that in this case also only incomplete combustion results, with high emissions.

There is known from P42 04 320.4 a water heater, which has two combustion stages, i.e. via an air-gap burner and a monolithic burner as a second stage. However, here also it has become apparent that the first stage, due to pre-mixing of the gases, involves the abovenamed disadvantages.

SUMMARY OF THE INVENTION

Proceeding from this prior art, the purpose of the invention is further to develop a catalytic burner as described above without pre-mixing, in such a way that almost total combustion particularly of fuel gases containing hydrocarbons is effected, so that a high degree of efficiency and low emissions are achieved. The burner is further intended to be characterised by a simple and cost-effective construction, This object may be achieved by a two-stage catalytic burner that includes a first combustion stage that includes a diffusion burner having a first chamber with a fuel gas separated from the second chamber with a combustion gas by a catalytic layer permeable to the fuel gas. A burner element that includes a highly porous catalytically active material with a porosity of greater than approximately 50% and pore size of approximately 0.001 to 100 $\mu$m and a thickness of approximately 0.05 to 10 mm may also be included. A fuel gas may be fed into the first chamber and a combustion gas may be fed into the second chamber.

By virtue of the fact that a burner element is initially provided, which consists only of a highly-porous material permeable by the fuel gases, the catalytic combustion takes place at the continuous catalytic structures both in the interior and also on the surfaces of the porous burner element. By means of integrating such a diffusion burner in a two-stage burner, almost complete combustion is guaranteed. Thus it is possible to provide almost total combustion not only of hydrogen, but also in particular of natural gas and other fuels containing hydrocarbons, such for example as propane, butane, methanol, diesel oil or gasoline, so that a considerably reduced emission of CO compared to prior art is achieved, and also of unconsumed fuel gas.

The necessary high porosities of >50% and the pore size between 0.001 and 100 $\mu$m may be achieved if extremely fine metallic powders with particle sizes in the range of 0.01 to 10 $\mu$m are used as initial materials. Particularly advantageous in this case are powders produced from metallic carbonyl compounds, such for example as carbonyl nickel. Thus all catalytically active metals available in the form of metal carbonyls are suitable as initial materials. The screen sizes of these powders lie within the $\mu$m range. The individual granules however consist of chain-like structures, which combine many smaller individual metallic particles together. It is possible by means of this special structure to produce extremely fine-pored highly porous metallic layers. It is not only possible to use the abovementioned compounds, such for example as carbonyl nickel powder, as initial materials, but also mixtures of such powders, e.g. with carbonyl iron powder. These two materials are of particular interest as they may be produced on an industrial scale. However, for doping purposes and in order to improve thermal stability, other metallic powders which need not be produced from metal carbonyls, such for example as chromium, manganese, magnesium, lanthanum, zirconium, yttrium, aluminium, etc., may be admixed. Additives of oxide powders such for example as $Al_2O_3$, $SrTiO_3$, are suitable to prevent the porous nickel structures from sintering together during operation of the burner at high temperatures.

It is advantageous if the porosity, starting from the chamber filled with fuel gas, increases in an outward direction, i.e. towards the chamber filled with the combustion gas. In this way an increased heat conductivity is achieved in the inner portion of the burner elements, which favours an endothermic preliminary reaction (partial reformation) of the fuel gases on the catalyst layer facing the fuel gas chamber.

In a further advantageous development of the invention, not only is the porosity varied, but also the median pore size distribution. It has become apparent that it is particularly favourable in this case if the median pore size distribution, starting from the chamber filled with fuel gas, increases in the direction of the chamber containing combustion gas. The high porosity with large pore radii of the burner element on the side facing the combustion gas is advantageous for exchange with the combustion air.

In a further advantageous embodiment, the highly-porous catalytic material is applied to carrier permeable to the fuel gas. In this way it is possible to produce extremely thin highly active catalytic layers. Particularly favourable is the use of porous carrier materials such for example as perforated or slotted plates, metal meshes, sintered metallic members, weaves, nets, fleeces, or foams. Due to the similar heat expansion coefficients to the catalyst structure itself, it is advantageous if metallic carrier materials are used; also suitable however are ceramic carrier materials.

This carrier, coated with the porous catalytic material is produced in that a so-called "slurry" containing the metallic powders described above is stirred up with water and an organic binder; the mixture so produced may then be further processed in various ways. On the one hand the carrier materials may be coated by painting, saturation, spraying or other application techniques. After application or coating, the slurry is then dried in a drying cabinet at approximately 150° C. Burning-out of the binder and formation of the cohesive metallic layer may now be effected in a separate sintering process, e.g. at 900° C. over 10 minutes in an inert gas atmosphere, or directly when first used as a burner.

Another method of producing coatings of metal alloys, in contrast to that described above, is based on ready-sintered structures, which are likewise produced from carbonyl nickel powders. Formation of the alloy is effected in connected processes. For most catalytically active metals, except for the very base ones, such for example as aluminium, saturation processes are suitable. In this case nitrate solutions of the respective metals are used, e.g. aqueous cobalt, magnesium or chromium nitrate solution, and the sintered nickel structure is saturated with these solutions. Then a calcination phase at approximately 450° C. for 4 hours in air, and a diffusion treatment at 700° C. for 30 minutes in a reducing atmosphere, e.g. in hydrogen, may be effected.

Intermetallic nickel-aluminium phases may also be generated by diffusion processes, in which the porous nickel structures are sintered in a mixture of powders of aluminium, aluminium oxide and ammonium chloride at approximately 700° C. for several hours in an inert gas atmosphere.

BRIEF DESCRIPTION OF THE DRAWINGS

Further features, details and advantages of the invention will become apparent from the following description of preferred embodiments of the invention, and with reference to the drawings, which show.

DETAILED DESCRIPTION OF THE PREFERRED EMBODIMENTS

Figure 1:
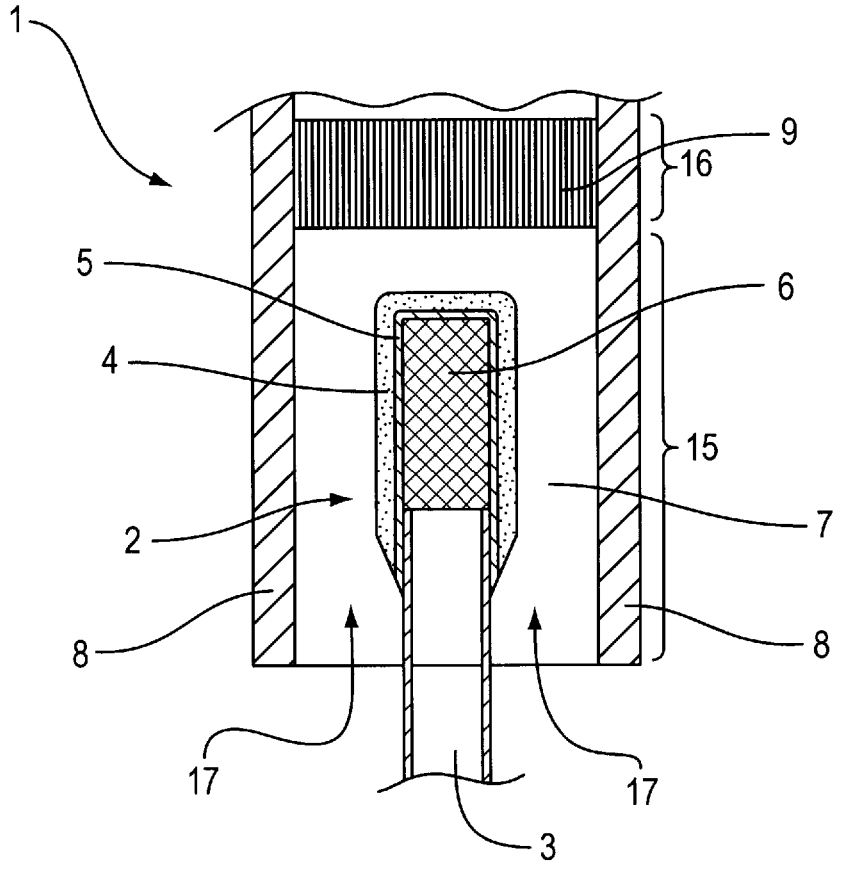
FIG. 1: a cross-section through the two-stage catalytic burner.

The embodiment according to FIG. 1 illustrates a particularly preferred variant of the invention. The first combustion stage (15) is in the form of a tubular diffusion burner and precedes the second combustion stage (16); it is in other words particularly advantageous to use a tubular burner bar 2. This tubular burner bar 2 consists of an approximately cylindrical feed tube 3 and a cylindrical burner element 4, which is connected to the end lying opposite the feed tube 3. The feed tube 3 and the free inner chamber of the burner element 4 form an enclosed chamber 6 through which the fuel gas flows, and which is connected to a fuel gas supply which is not illustrated. The burner element 4 separates the chamber 6 containing the fuel gas from the oxidiser, e.g. atmospheric oxygen, which is located in the chamber 7, formed by the side of the burner element 4 facing the chamber 7 and the inner side of the casing wall. The casing inner wall may also in addition be the inner side of a vessel provided with a heat-exchanger 8. The supply of oxidising agent (not shown) may be effected convectively or by forced flow, e.g. by means of a blower through the feed lines 17.

The design of the burner element is essential to the invention. The burner element represents an extremely catalytically active layer with a wall thickness of approximately 0.5 to 10 mm, The burner structure is porous, with pores in the range from 0.001 to 100 $\mu$m, and has excellent heat conductivity. In this case the burner element preferably substantially consists of metallic materials. The burner element is produced as described above preferably from fine metallic powders with particle sizes in the range from 0.01 to 10 $\mu$m as outset materials. It is advantageous in this respect that organometallic compounds such for example as carbonyl nickel are used. The screen sizes of these powders lie within the micrometric range. In the embodiment according to FIG. 1, the burner element is thus applied to a carrier material 5. The burner element 4 can in this case fill the carrier or even extend through the carrier, and represent a layer defining the chamber 6.

It is particularly advantageous for the catalytic burner according to the invention to use nickel or nickel-containing alloys, as nickel is an extremely good reformation catalyst and a good oxidation catalyst.

The burner element 4 is produced by forming a carrier 5, for example from wire mesh, perforated sheet metal, metal mesh or similar permeable structures with individual openings of <5 mm, e.g. a cylinder closed at one end which, after coating with active material, represents the burner element 2. It is particularly favourable if the carrier structure 5 also consists of nickel or nickel-containing materials. A simple coating process is based on carbonyl nickel powders, which are processed to form a slurry in an aqueous solution; for example, coating may be effected by saturation of the carrier structure 5 in the slurry. Then a sintering process is carried out in a protective gas at 1000° C. This manufacturing technique very simply permits variations in porosity, pore distribution, coating thickness and catalytic selectivity by the use of various nickel powder fractions, quantities of water and additions of pore formers, e.g. plastics powders, and by the addition of traces of other active elements, which for example improve the activity for reformation or CO oxidation. By means of multiple repetition of the coating procedure, catalytically active overall coatings with structural and catalytic properties variable well beyond the thickness, may be constructed.

It is of particular advantage to have the porosity increase, starting from the chamber 6 filled with fuel gas, in an outward direction towards the chamber 7 filled with air. In this way an increased heat conductivity in the internal portion is achieved, which favours an endothermic preliminary reaction (partial reformation) of the fuel gases at the catalytic layer facing the chamber 6. It is of further advantage if the median pore size distribution likewise increases from the inside outwards. The required high porosity with large pore radii desirable on the outer side of the element 4, is favourable to the exchange with the combustion air.

With regard to the additions of other selectivity-increasing materials, it is advantageous to add in the internal range of the coating 4, for example Cu, Fe, Nb in order to improve the kinetics of reformation, and to accelerate the selective CO oxidation in the outer region, e.g. Co, Pt, Fe.

The technology of multiple coatings further offers the advantage that the hydraulic resistance of the catalyst structure may be modified continuously or in stages over the length beginning from the fuel gas inlet, e.g. by the application of additional layers on partial areas of the element. In this way for example the pressure-drop over the length of the catalyst structure may be compensated for.

The two-stage catalytic burner is constructed in such a way that a burner bar 2 as described above of a second combustion stage 16, is incorporated, seen in the flow direction, after the chamber 7 containing the combustion gas. The burner bar 2 is integrated in a two-stage catalytic burner in such a way that the burner bar 2 represents the first stage, in which a conversion of 70 to 90% is achieved, while a second stage following the first stage ensures total conversion. In this case the second stage is so constructed that the subsequent chamber 9 is more advantageously filled with ceramic or metallic material or with a catalyst honeycomb, such as is known in exhaust cleaning in automobiles. This arrangement is extraordinarily favourable if the supplied combustion air is already preheated, e.g. by exhaust heat-exchangers or, as is the case with gas turbines. In gas turbines, by means of compression of the air to 10 to 20 bar, heating of the air to approximately 400° C. is achieved. By means of the diffusion principle the air may even be heated above the self-ignition temperature of the fuel gas/air mixture, without extinguishing ignitions, as in the case of the pre-mixing burner.

At extremely high exhaust gas temperatures after the first stage, in the range of approximately 800° C., it may be sufficient to prepare, instead of a catalytic monolith, a hot reaction chamber in which the exhaust gases, after leaving the first burner stage, remain for a certain period, approximately <1 second, and are thermally oxidised at that point. Thermal oxidation may be improved by the incorporation of substantially ceramic members in the chamber 9. There may for example be used for this purpose uncoated monoliths of $Al_2O_3$ or $ZrO_2$. As these materials support considerably higher temperatures than most catalysts, which at above 1200° C. usually only have a restricted life-expectancy, the purely thermal oxidation reactions may be carried out at even higher temperatures. These high exhaust gas temperatures in the range of 1300° C. will be required by future generations of gas turbines.

In the case of gas turbines, combustion takes place under increased pressures. This means that the pressure between the supplied combustion air and the fuel gas fed in within the burner elements must be adjusted. The pressure must be almost equal, as at too high an air pressure the air would be forced through the element 4 into the fuel chamber 6, or at too high a fuel gas pressure, fuel gas would be emitted into the air chamber, with flame formation. The pressure-differential should be regulated in such a way that the catalytic combustion reaction takes place in the zone of the element 4, either inside or near the surface.

In the case of gas turbines which are operated, depending on the desired turbine input temperature, with a specific excess of air, it may be favourable in the case of the two-stage burner described, to supply only the slightly leaner-than-stoichiometric quantity of air (air number 1.0 to 1.2) into the burner, in order that the quantity of gas to be heated up in this first stage remains minimal, and thus extremely high temperatures may be achieved, with operation with natural gas, as far as the range of 1800° C. In order to bring the heating gases to the lower turbine inlet temperatures, a partial air flow from the compressor into the heating gas flow, which is leaving the catalytic burner, may be mixed in, until the desired gas temperature is reached. In addition to the air supply described, it is naturally also possible to feed in the entire quantity of air directly into the first burner stage.

Figure 2:
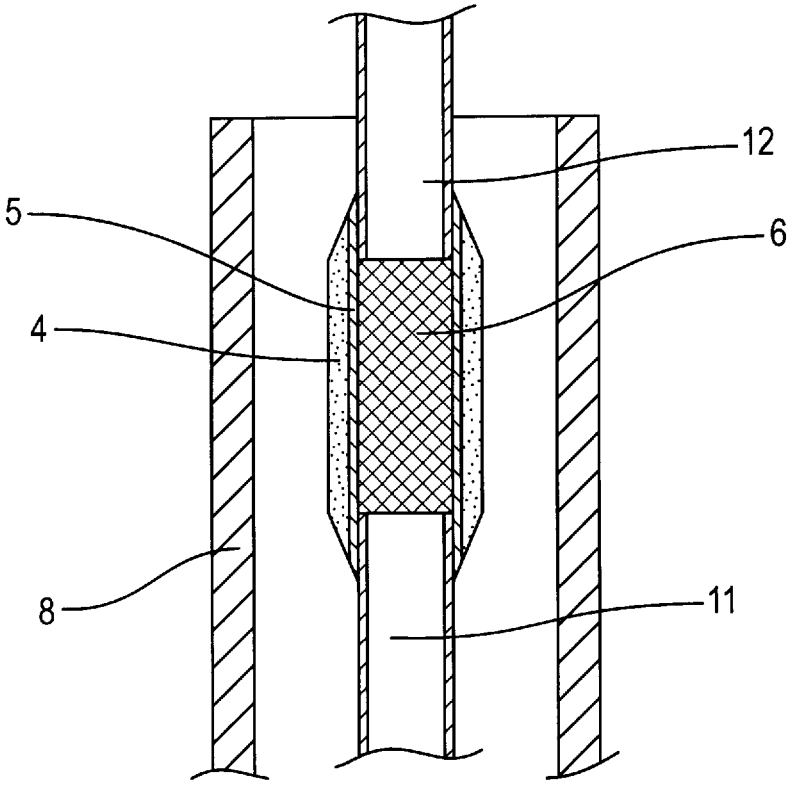
FIG. 2: an embodiment of the first stage with two tubular feeds.

FIG. 2 shows a cross-sectional view of a tubular catalytic burner with carrier-supported catalyst structure and fuel gas supply from both sides. This catalytic burner is so constructed that two feed lines 11, 12 are provided, which are more preferably tubular. The two tubular feed lines are guided towards one another, but do not touch one another. The free chamber between the two tubular feed lines now forms the fuel gas chamber 6. The burner element is constructed as described above. This diffusion burner is used as a first stage, similarly to FIG. 1.

Figure 3:
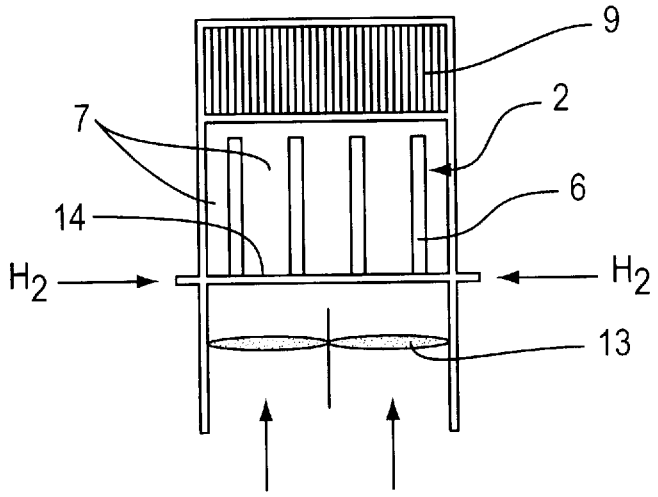
FIG. 3: a two-stage embodiment with several burner bars incorporated in series.

FIG. 3 shows a two-stage catalytic burner with burner bars disposed in parallel and an air blower.

Catalytic two-stage burners may be produced in various geometric configurations, e.g. as flat plates, as cylindrical rods, as spheres, etc. An essential factor in this case is the separation of the fuel gas chamber 6 and the chamber 7 containing the combustion gas by means of the burner element 4. For example, burner bars 2 may be spatially oriented in various ways, e.g. horizontally, diagonally or vertically. Guidance of the air along the variously oriented burner bars 2 may in turn be parallel, diagonal or vertical to the alignment of the bars. In the embodiment according to FIG. 3, the burner bars and the air flow are aligned in parallel. They also however lead to one another vertically or at any other angle. In this case the combustion gas is passed via an air blower 13 parallel to the burner bars 2. The fuel gas (hydrogen) is passed through a feed device 14 to the burner bars 2. In the subsequent area 9, which is filled with ceramic or metallic material or with a catalyst honeycomb, an after-burning takes place. An advantage in this embodiment is that considerably higher performances may be achieved by the burner bars which are in this case disposed in parallel.

Figure 4:
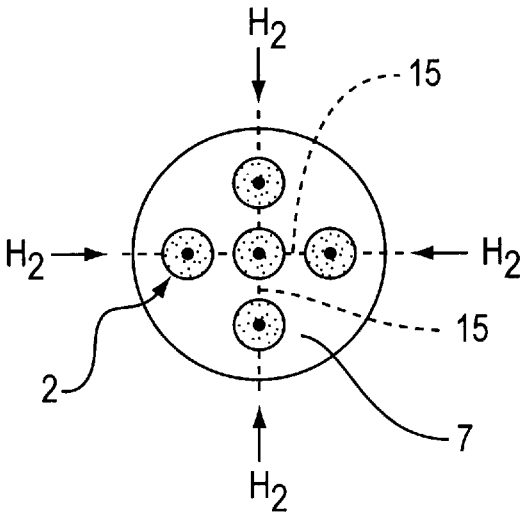
FIG. 4: an embodiment of the arrangement of burner bars in a chamber containing combustion gas.

FIG. 4 shows a simple parallel arrangement of burner bars 2. A plurality of burner bars 2 are in this case supplied in parallel via a distributor structure 15 with fuel gas. The necessary combustion air is supplied convectively or via a blower (not shown) to the burner bars. The second combustion stage (not shown) is disposed in the flow direction above the first. This embodiment also provides a high performance yield.

What is claimed is:

1. A two-stage catalytic burner comprising:

at least one feed for one of a hydrogen and hydrocarbon-containing fuel gas;

at least one feed for a combustion gas including at least one of oxygen and air;

a first and second combustion stage;

the second combustion stage comprising a monolithic burner that passes a mixture of gases leaving the first combustion stage;

a heat exchanger enclosing the first and second combustion stages;

the first combustion stage comprising a diffusion burner having a first chamber supplied with the fuel gas and a second chamber supplied with the combustion gas;

the first and second chambers being separated by a catalytic layer permeable to the fuel gas;

the catalytic layer comprising a burner element comprising a highly porous catalytically active material with a porosity of greater than approximately 50% and pore size of approximately 0.001 to 100 $\mu$m and a thickness of approximately 0.05 to 10 mm.

2. The catalytic burner according to claim 1, the porosity of the burner element increases from a side facing the first chamber towards the second chamber.

3. The catalytic burner according to claim 1, a median pore size distribution of the burner element increases from a side facing the first chamber towards the second chamber.

4. The catalytic burner according to claim 1, the catalytic material comprising at least one catalytically active metal.

5. The catalytic burner according to claim 4, the at least one catalytically active metal comprising Ni.

6. The catalytic burner according to claim 4, the at least one catalytically active metal produced from metal carbonyls.

7. The catalytic burner according to claim 1, the burner element is applied to a carrier that is permeable to the fuel gas.

8. The catalytic burner according to claim 7, the carrier is selected from the group consisting of perforated plates, slotted plates, metal meshes, sintered metal members, weaves, nets, fleeces and foams.

9. The catalytic burner according to claim 7, the carrier comprising at least one metallic carrier material.

10. The catalytic burner according to claim 9, the burner element comprising a metal; and the at least one metallic carrier material comprising a metal substantially similar to the metal of the burner element.

11. The catalytic burner according to claim 1, the fuel gas feed comprising at least one tubular feed;

the first chamber comprising an approximately cylindrical chamber connected at a free end to the at least one tubular feed and closed at an end opposite the free end; and at least one burner bar being surrounded by the second chamber.

12. The catalytic burner according to claim 11, further comprising a plurality of burner bars supplied with the fuel gas through the at least one fuel gas feed and being located in the second chamber.

13. The catalytic burner according to claim 12, the burner bars being arranged in parallel.

14. The catalytic burner according to claim 1, the second combustion stage comprising a chamber that is at least partly filled with at least one of metallic, ceramic and catalytic structures.

15. The catalytic burner according to claim 1, the fuel gas feed comprising two tubular feeds;

each tubular feed having an open end;

the open ends being guided towards each other;

the open ends forming a chamber between the open ends of the tubular feeds;

the chamber being surrounded by an approximately cylindrical burner element.

* * * * *